US008733961B2

(12) United States Patent
McGowan et al.

(10) Patent No.: US 8,733,961 B2
(45) Date of Patent: May 27, 2014

(54) UNIFORM LIGHTING SYSTEM

(75) Inventors: John G. McGowan, Ottawa (CA); W. David Keys, Ottawa (CA); Jean Giroux, Saint-Augustin de Desmaures (CA)

(73) Assignee: Triplet Music Products, Inc., Ottawa, Ontario (CA)

( * ) Notice: Subject to any disclaimer, the term of this patent is extended or adjusted under 35 U.S.C. 154(b) by 48 days.

(21) Appl. No.: 13/415,197

(22) Filed: Mar. 8, 2012

(65) Prior Publication Data

US 2013/0235569 A1 Sep. 12, 2013

(51) Int. Cl.

| | |
|---|---|
| ***A47B 19/00*** | (2006.01) |
| ***F21V 11/00*** | (2006.01) |
| ***F21V 7/00*** | (2006.01) |
| ***F21V 33/00*** | (2006.01) |
| ***F21V 21/00*** | (2006.01) |
| ***F21S 4/00*** | (2006.01) |
| ***F21V 19/02*** | (2006.01) |
| ***G09F 13/00*** | (2006.01) |

(52) U.S. Cl.
USPC ..... 362/98; 362/240; 362/247; 362/234; 362/217.01; 362/219; 362/220; 362/217.13; 40/560; 40/563

(58) Field of Classification Search
USPC ..... 362/98, 99, 109, 240, 245, 247, 234, 362/217.01, 219, 220, 217.13; 40/559, 560, 40/563
See application file for complete search history.

(56) References Cited

U.S. PATENT DOCUMENTS

| | | | | |
|---|---|---|---|---|
| 3,079,491 | A | 2/1963 | Janssen | 240/4 |
| 3,885,145 | A * | 5/1975 | Wise | 362/99 |
| 4,153,927 | A | 5/1979 | Owens | |
| 4,290,093 | A | 9/1981 | Thompson et al. | 362/98 |
| 4,680,681 | A | 7/1987 | Fisherman et al. | 362/98 |
| 5,381,310 | A | 1/1995 | Brotz | 362/32 |
| 6,088,941 | A | 7/2000 | Inbar et al. | |
| 6,280,052 | B1 | 8/2001 | White | |
| 6,520,643 | B1 | 2/2003 | Holman et al. | |
| 6,558,014 | B2 | 5/2003 | Just et al. | 362/33 |
| 6,830,356 | B2 * | 12/2004 | Larocque | 362/98 |

(Continued)

FOREIGN PATENT DOCUMENTS

| | | | |
|---|---|---|---|
| EP | 1 371 897 | 6/2003 | |
| EP | 1371897 | 12/2003 | |
| FR | 2424004 A * | 12/1979 | |
| WO | WO 95/33624 | 12/1995 | B42D 9/00 |

OTHER PUBLICATIONS

Machine translation of Fontoynont, EP 1,371,897 A1, published Dec. 17, 2003.*

(Continued)

*Primary Examiner* — Ismael Negron
*Assistant Examiner* — William N Harris
(74) *Attorney, Agent, or Firm* — Nixon Peabody LLP

(57) ABSTRACT

A light bar for illuminating a surface that is substantially perpendicular to the light bar includes an elongated housing extending along an edge of the surface to be illuminated. The housing has a wall adjacent the surface to be illuminated, and at least portions of that wall are transparent. A series of light emitting diodes (LEDs) are mounted within the housing and spaced along the length of the housing for illuminating the surface, and a connector couples the LEDs to an electrical power source for energizing the LEDs to produce light that illuminates the surface.

9 Claims, 8 Drawing Sheets

(56) References Cited

U.S. PATENT DOCUMENTS

| | | | | |
|---|---|---|---|---|
| 6,951,403 | B2 | 10/2005 | Bennett, Jr. | 362/98 |
| 6,954,260 | B2 | 10/2005 | Arnold et al. | |
| 7,001,060 | B1 | 2/2006 | Kimura | |
| 7,261,435 | B2 | 8/2007 | Gould et al. | |
| 7,611,260 | B1 * | 11/2009 | Lin et al. | 362/224 |
| 7,695,180 | B2 | 4/2010 | Schardt et al. | |
| 2003/0103351 | A1 | 6/2003 | Privas et al. | |
| 2008/0204888 | A1 | 8/2008 | Kan et al. | |
| 2011/0116265 | A1 * | 5/2011 | Salm | 362/247 |
| 2012/0176786 | A1 | 7/2012 | Presley et al. | |

OTHER PUBLICATIONS

Abileah, A. "Backlight-Unit Basics." Information Display: Guest Editorial. vol. 28, No. 4, Apr. 2012, pp. 6, 48 (2 pages).

Lee, H-W. et al. "Improvement of Illumination Uniformity for LED Flat Panel Light by Using Micro-Secondary Lens Array." Optics Express. vol. 20, No. Suppl. 6, Nov. 5, 2012, pp. A788-A798 (11 pages).

"Triplet Light Quick Reference Guide." Triplet Music Inc. [online], [retrieved Nov. 13, 2013] Feb. 21, 2013. Retrieved from the Internet: <URL: https://www.tripletlight.com//sites/default/files/uploads/user-manual/tripletlight_instructions_july23.2013.pdf> (4 pages).

"The World is Our Stage." Manhasset Specialty Company: Product Brochure [online], [retrieved on Nov. 13, 2013] Oct. 5, 2011. Retrieved from the Internet: <URL: http://www.manhasset-specialty.com/pdfs/ManhassetCatalog-HighRes.pdf>(8 pages).

International Search Report and Written Opinion mailed Jul. 15, 2013 which issued in corresponding International Patent Application No. PCT/CA2013/000200 (10 pages).

* cited by examiner

UNIFORM LIGHTING SYSTEM

FIELD OF THE INVENTION

The present invention relates to a lighting system, and, more particularly, to a system for lighting a substantially flat page, book, or artwork.

BACKGROUND OF THE INVENTION

Musicians have struggled for centuries with properly lighting their music score on their music stand, on a piano or organ, or held in their hands while singing.

Musicians perform and rehearse in many locations such as auditoriums, churches, private homes, and even outdoors. Lighting conditions are often poor thus making it difficult for the musicians to read the music.

Available music lighting solutions include basic and more expensive clip-on lights, basic piano lamps, expensive overhead racking and room lighting, and modified household lighting fixtures.

Generally, all music lights illuminate the music from above, employing a halogen, incandescent, or LED lamp attached to a fixed or flexible goose neck, which is attached to the music stand by means of a crude spring tensioned clamp or placed directly on the surface of a keyboard instrument.

Standard music stand lights and piano lights present many problems, such as inconsistent lighting of the music score both in brightness and in coverage, excessive over-lighting, glare and light in the eyes of the musician, obstruction of the important musician's view of the audience or the conductor, critical eye contact between musicians themselves, and obstruction of the audience's view of the musician. Used on a piano, the overhead light detracts from the beauty of the piano, organ, or music stand.

Generally, the lights require electrical power and in most orchestra settings, this means the use of several extension cords that can be hazardous and unsightly.

For vocalists there are no sensible lighting solutions and they are generally left to rely on whatever room lighting is available.

There are other applications such as artwork lighting and lighting for book reading that share similar issues.

There is a need for a lighting system that provides substantially uniform lighting of a page or other substantially planar and vertical object such as artwork or book. The lighting system must provide minimal spillage outside the light area and must be non-intrusive to the eyesight. It is also desirable that the lighting system be lightweight with low power consumption, low heat dissipation and is optionally battery operable.

SUMMARY OF THE INVENTION

A light bar for illuminating a surface that is substantially perpendicular to the light bar includes an elongated housing extending along an edge of the surface to be illuminated. The housing has a wall adjacent the surface to be illuminated, and at least portions of that wall are transparent. A series of light emitting diodes (LEDs) are mounted within the housing and spaced along the length of the housing for illuminating the surface, and a connector couples the LEDs to an electrical power source for energizing the LEDs to produce light that illuminates the surface. In many applications, such as sheet music stands, the surface to be illuminated is substantially vertical, the light bar extends along the bottom edge of the surface, and the wall adjacent the surface is the top wall of the housing.

In one implementation, the LEDs are oriented to direct light produced by the LEDs through the transparent portions of the wall of the housing and onto the surface to be illuminated. The LEDs may be arranged in multiple rows extending along the length of the housing, with the LEDs in different rows oriented to direct light onto different regions of the surface, so that the surface is illuminated substantially uniformly over its entire area. The number of LEDs in the rows preferably varies according to the distances between the light bar and the regions illuminated by the respective rows of LEDs in the light bar, i.e., the rows illuminating more distant regions of the surface contain more LEDs than rows illuminating less distant regions of the surface.

Another implementation includes a reflector within the housing of the light bar for reflecting light produced by the LEDs onto the surface to be illuminated. The reflector may include a first mirror oriented to illuminate a distant region of the surface, and a second mirror oriented to illuminate a closer region of the surface.

The light bar may be pivotably connected to the surface to be illuminated so that the wall of the housing adjacent the surface to be illuminated can be used as a ledge to support the bottom edges of sheet music or other documents resting against the surface to be illuminated. The light produced by the LEDs in the light bar then illuminates the front surface of the sheet music resting against that surface. In one implementation of this embodiment, the light bar housing and the surface to be illuminated are adapted to form a portfolio for carrying the sheet music or other documents.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings. Embodiments of the present invention will now be described, by way of example only, with reference to the attached Figures.

DETAILED DESCRIPTION OF THE ILLUSTRATED EMBODIMENTS

Although the invention will be described in connection with certain preferred embodiments, it will be understood that the invention is not limited to those particular embodiments.

On the contrary, the invention is intended to cover all alternatives, modifications, and equivalent arrangements as may be included within the spirit and scope of the invention as defined by the appended claims.

This invention is directed to a lighting system or a light bar that is designed to uniformly light a substantially vertical and planar surface such as sheet music, artwork or book. In one embodiment, one or more light bar is integrated to a portfolio, which can be placed on a free standing music stand, piano music stands or held by hand for reading or for choir singing. The portfolio can be designed to fold into a thin, flat case that can be used to also carry the sheet music, paper or a book.

In another embodiment, the light bar is integrated with a picture or artwork frame, to uniformly light the picture or artwork.

In another embodiment, the light bar is integrated into the ledge of a music stand.

Figure 1:
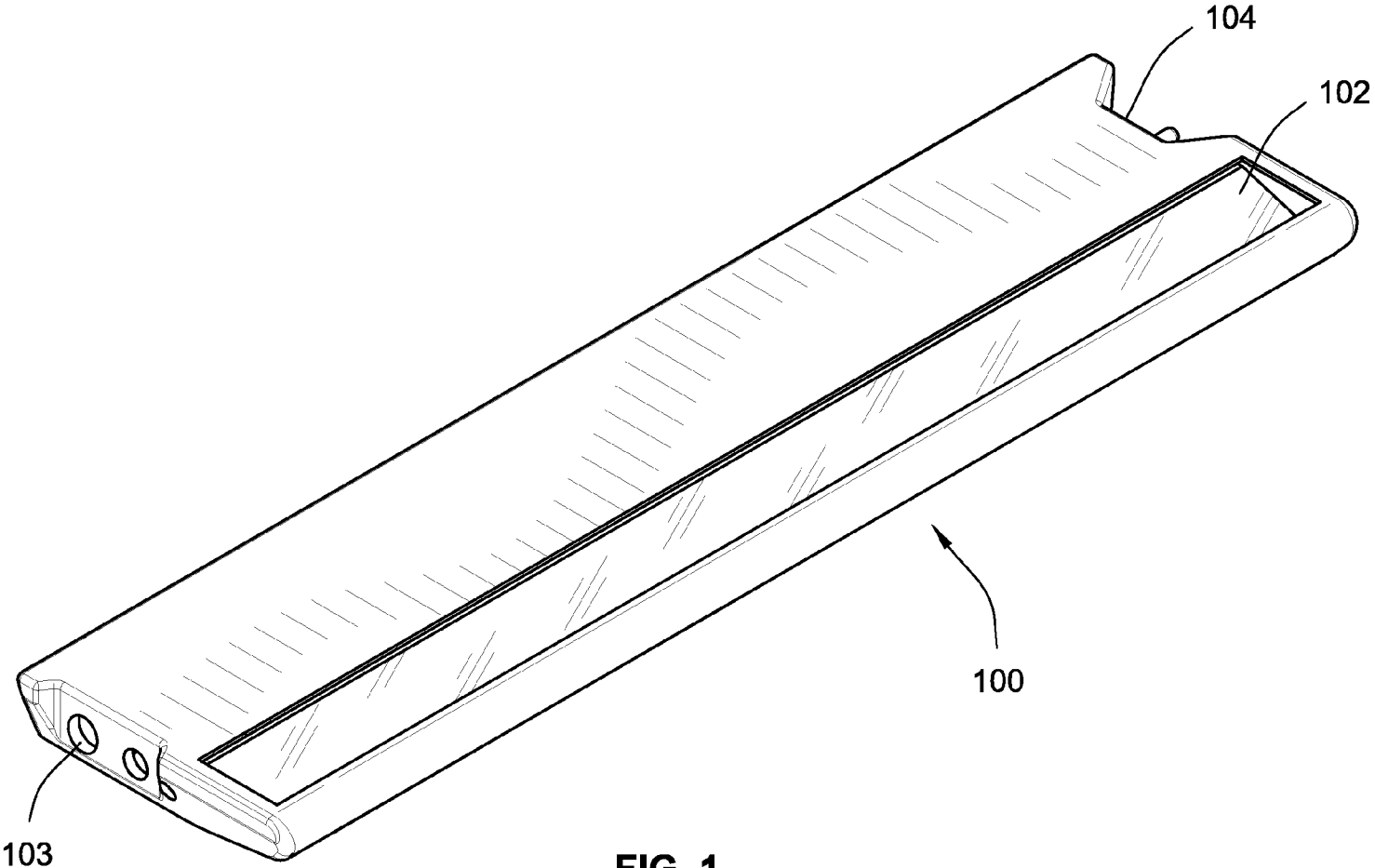
FIG. 1 shows an exemplary embodiment of a light bar.

The light bar generally comprises a housing with room for an electrical power supply or a battery system (dry or rechargeable). The housing includes one or more LEDs and an optical system for distributing the light generated from the LEDs according to a substantially uniform pattern. The optical system comprises one or more devices that transmit, reflect, diffuse or scatter the light. Referring to FIG. 1, an exemplary light bar housing 100 has a substantially thin rectangular shape, with an opening 102 in the housing wall, which includes a light source and an optical system for the distribution of light generated by the light source. Instead of a single opening 102, the housing 100 can have a plurality of transparent portions in the wall. Optionally, controls 103 and a power switch 104 can also be provided.

Figure 2:
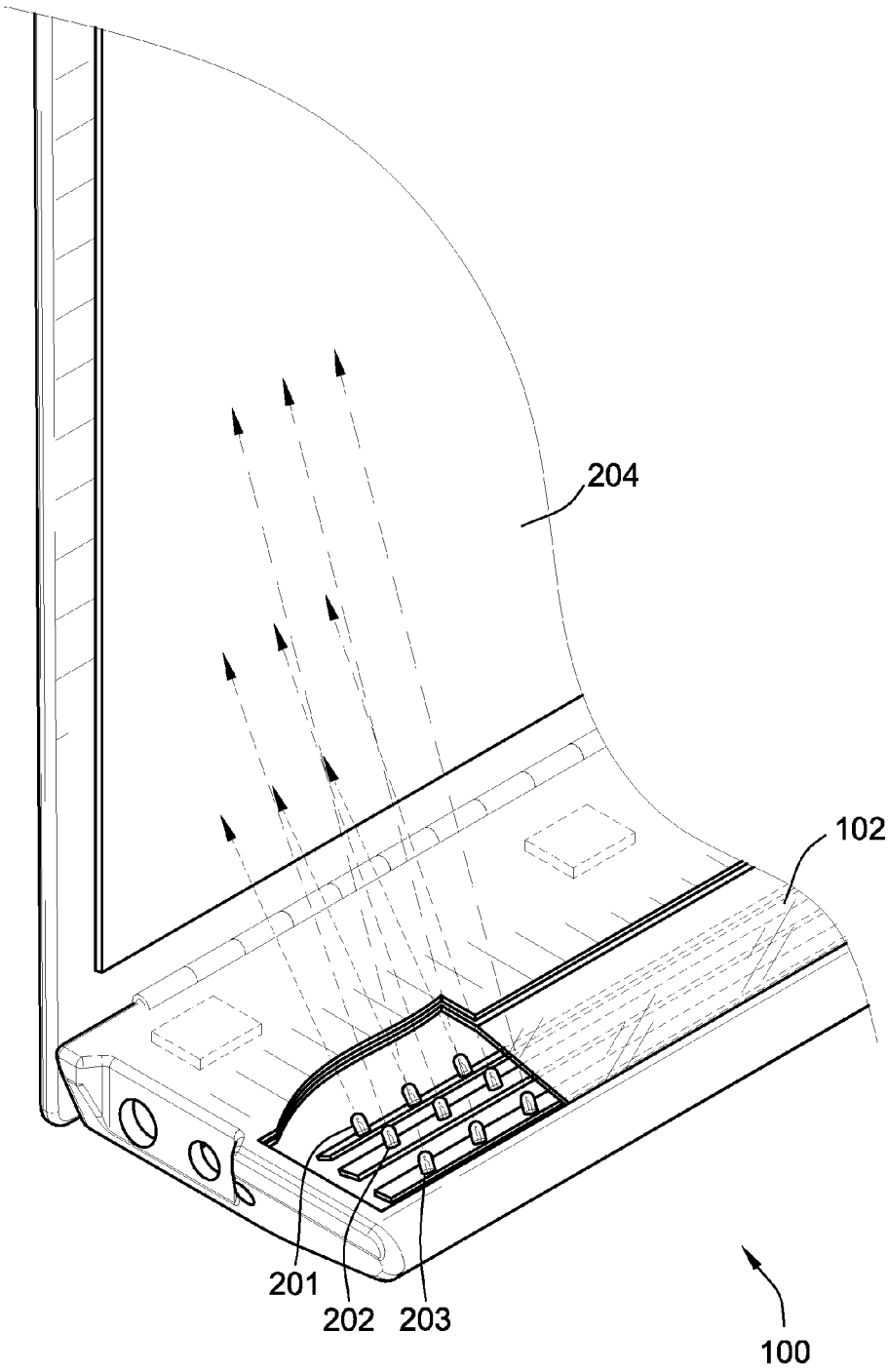
FIG. 2 shows an exemplary direct lighting implementation of a light bar.

Referring to FIG. 2, in one embodiment for the opening 102, the light source includes a plurality of LEDs rows 201, 202, 203 that are mounted within the elongated housing 100, each row providing a predetermined number of LEDs angled to light a specific area of a substantially vertical planar surface 204. In this case, the light is transmitted directly out of the light bar housing 100 through its wall. The number of LEDs per rows and the number of rows is determined as a function of the size of the planar surface. The LEDs in one row can be angled to a specific area of the planar surface. LEDs in one row may optionally be aimed at a different angle. In the example of FIG. 2, a first row 201 includes a first number of LEDs aimed at the bottom of the surface 204, a second row 202 includes a second number of LEDs greater than the first number and angled to light the substantially middle part of the surface 204, and a third row 203 includes a third number of LEDs angled to light the substantially top part of the surface 204. The third number of LEDs is greater than the first and second number of LEDs. By increasing the amount of light going up to the top of the surface, substantially uniform lighting can be achieved over the entire area of the surface.

It would be understood by someone skilled in the art that the embodiment could be implemented with one or more rows, and the number of LEDs per rows can be engineered to achieve different uniformity and lighting strength as required.

Narrow beam LEDs can optionally be used for this embodiment. In this case, lenses can be added to direct the light from one or more LEDs positioned near outer edges of the housing 100 to prevent spillage of light on the edges.

The angle of the LEDs can optionally be controllable on a group or individual row basis to achieve uniformity on a higher or smaller surface while minimizing the spillage. The intensity of the LEDs can optionally be controllable on a group or individual basis.

Figure 3:
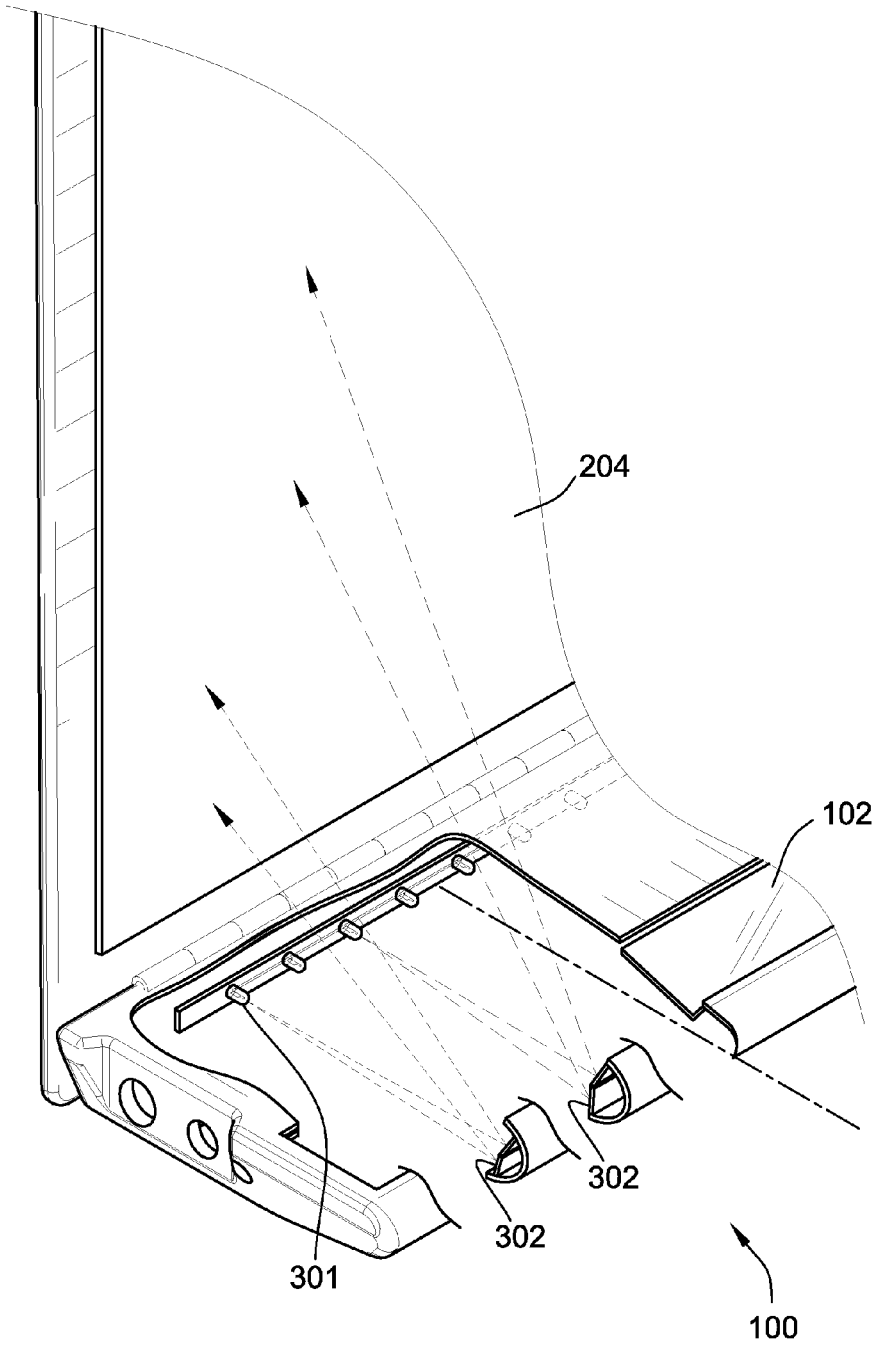
FIG. 3 shows an exemplary indirect lighting implementation of a light bar.
Figure 4:
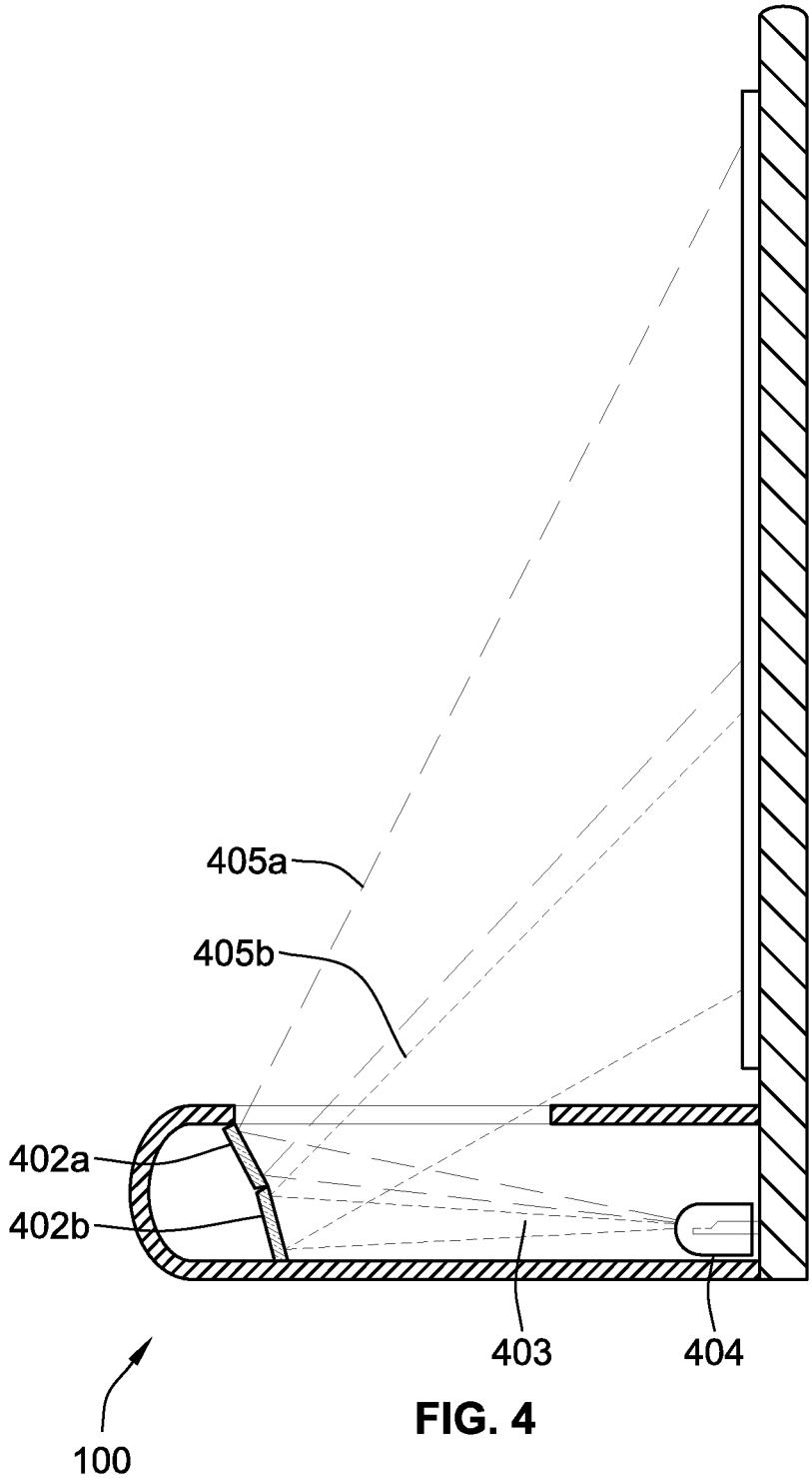
FIG. 4 shows a side cross-sectional representation of a light bar with results achieved by an indirect lighting implementation.
Figure 5:
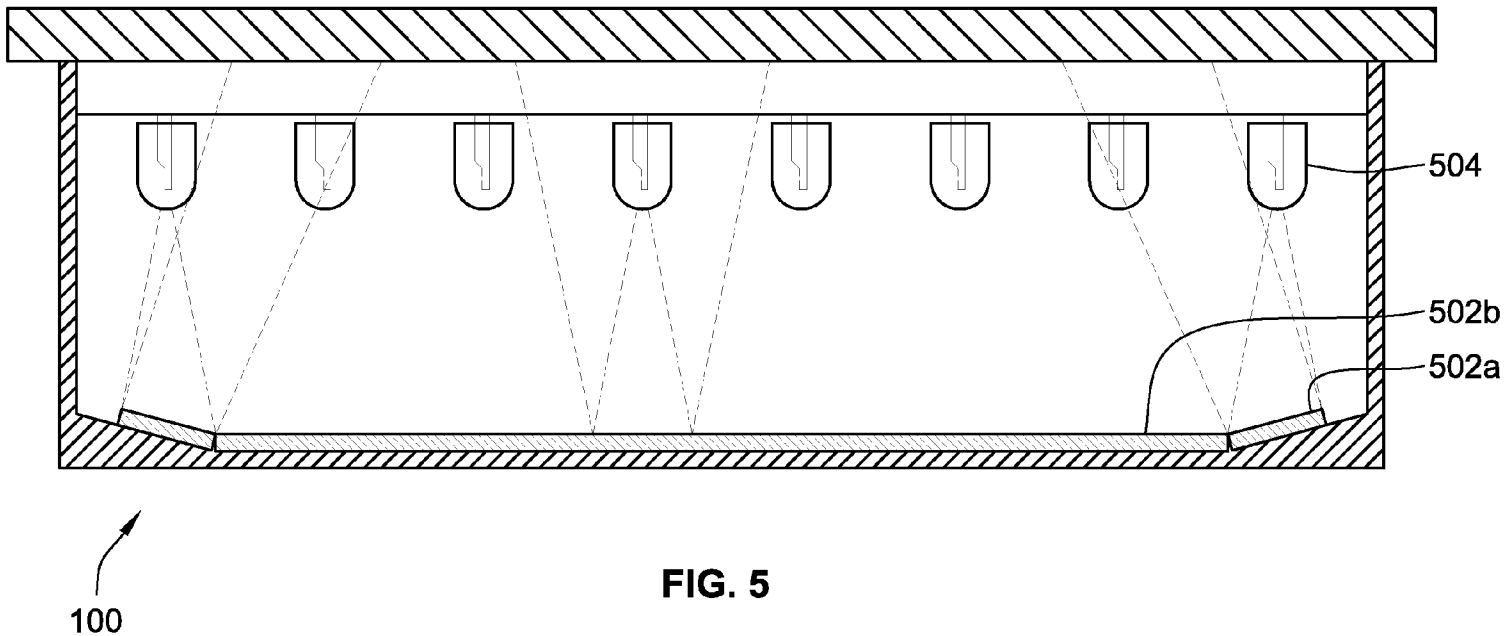
FIG. 5 shows a top cross-sectional representation of a light bar with results achieved by an indirect lighting implementation.

FIG. 3 depicts another embodiment in which a plurality of LEDs 301 is attached substantially vertically in the opening 102, and the optical system includes a reflector 302 (e.g., one or more mirrors) and optionally one or more lenses to redirect the light. In this embodiment, as per FIG. 4, the mirror consists of a split mirror 402*a*, 402*b* that redirects the light 403 from one LED 404 to create two light spots 405*a*, 405*b*. In reference to FIG. 5, several light spots can be created by using one or more angled LEDs 504, which are angled towards a split mirror 502*a*, 502*b*. Optionally, additional light spots can be achieved solely by splitting the mirror into segments 502*a*, 502*b*, or by using a concave mirror. An advantage of this embodiment is that the light source is not directly visible to the eye and therefore cannot interfere, regardless of the angle of the light bar.

With this embodiment, the angle of the projected light can optionally be controllable to achieve uniformity on a higher or smaller surface while minimizing the spillage by controlling the lenses and mirror angle. The intensity of the LEDs can optionally be controllable on a group or individual row basis.

One or more light bars can be integrated together to create a lighting system as described below.

The light bar optionally provides a standby mode in which a very low level of illumination is provided that can be switched directly to the previously set level of intensity with a single button push.

A power switch is provided to turn the light on and off. The intensity of the illumination provided by the light bar can be varied using a dimmer control allowing the user to adjust the intensity of light to their brightness preference, and to immediately compensate for changing lighting conditions. Each row of LED can be moved to aim at a different location independently. If multiple light bars are integrated into a system, then each light bar can be independently controlled or controlled together.

The light bar uses 'white' LEDs as the source of illumination. The LEDs should create minimal heat dissipation and power consumption should be such that the light bar can be operated at full intensity for several hours optionally using either chargeable batteries or a set of disposable dry cell that can be housed in the light bar. The batteries energize the LEDs to produce light and are coupled to the LEDs via a connector.

Figure 6:
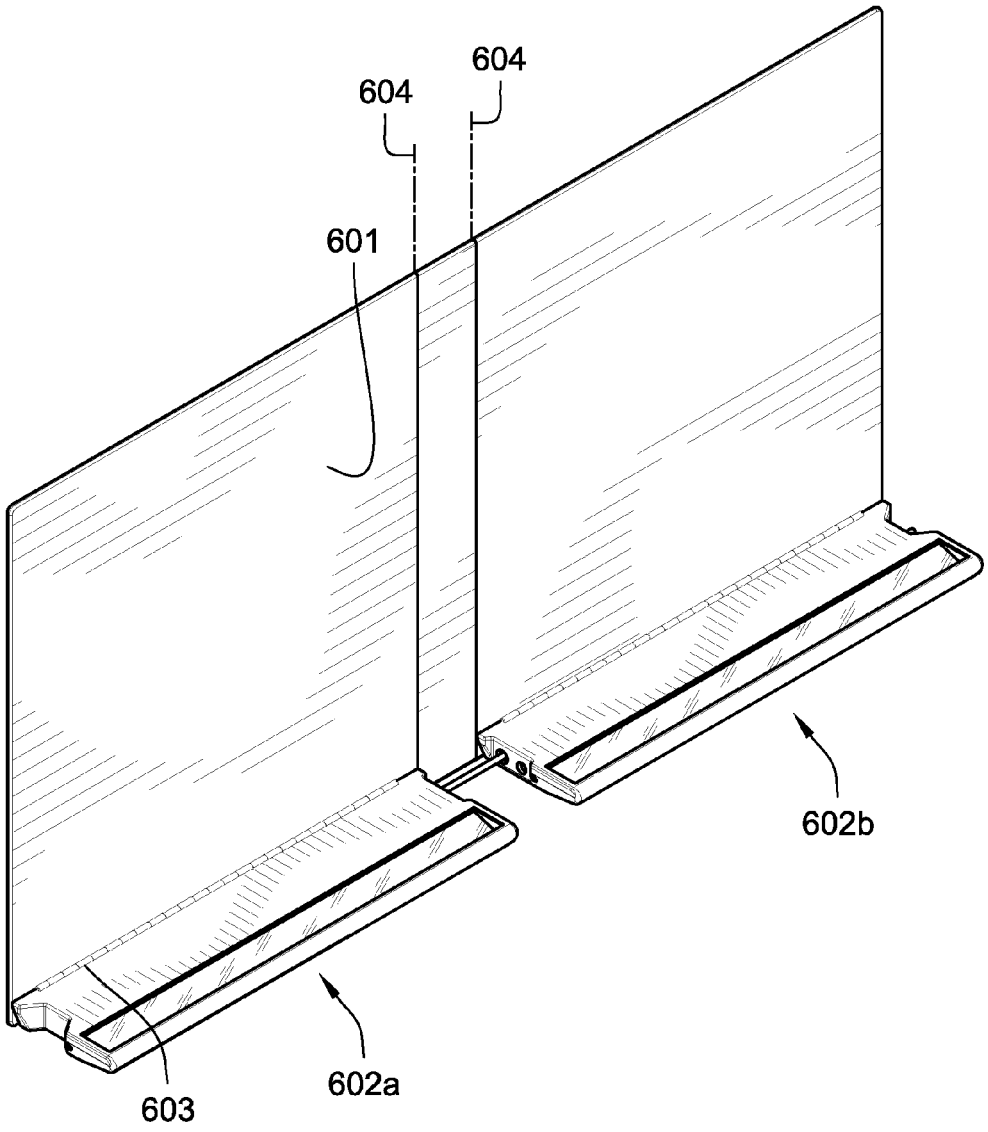
FIG. 6 shows a pair of light bars attached to a music portfolio.

The light bar can be integrated to a portfolio 601 or to a substantially rectangular planar component that can be supported by the music ledge of a music stand, which can support music scores or other documents. Referring to FIG. 6, an exemplary portfolio has two light bars 602*a*, 602*b* coupled to each side of the portfolio via a pair of hinges 603 for folding the light bars 602*a*, 602*b* into the portfolio (e.g., upwards or inwards). Folding the light bars 602*a*, 602*b* upwards facilitates storage and transportation, while folding the light bars 602*a*, 602*b* outwards (or downwards) facilitates illumination of both facing pages of a music score. When folded outwards, the light bars 602*a*, 602*b* also provide a ledge that can support the music score.

Figure 7:
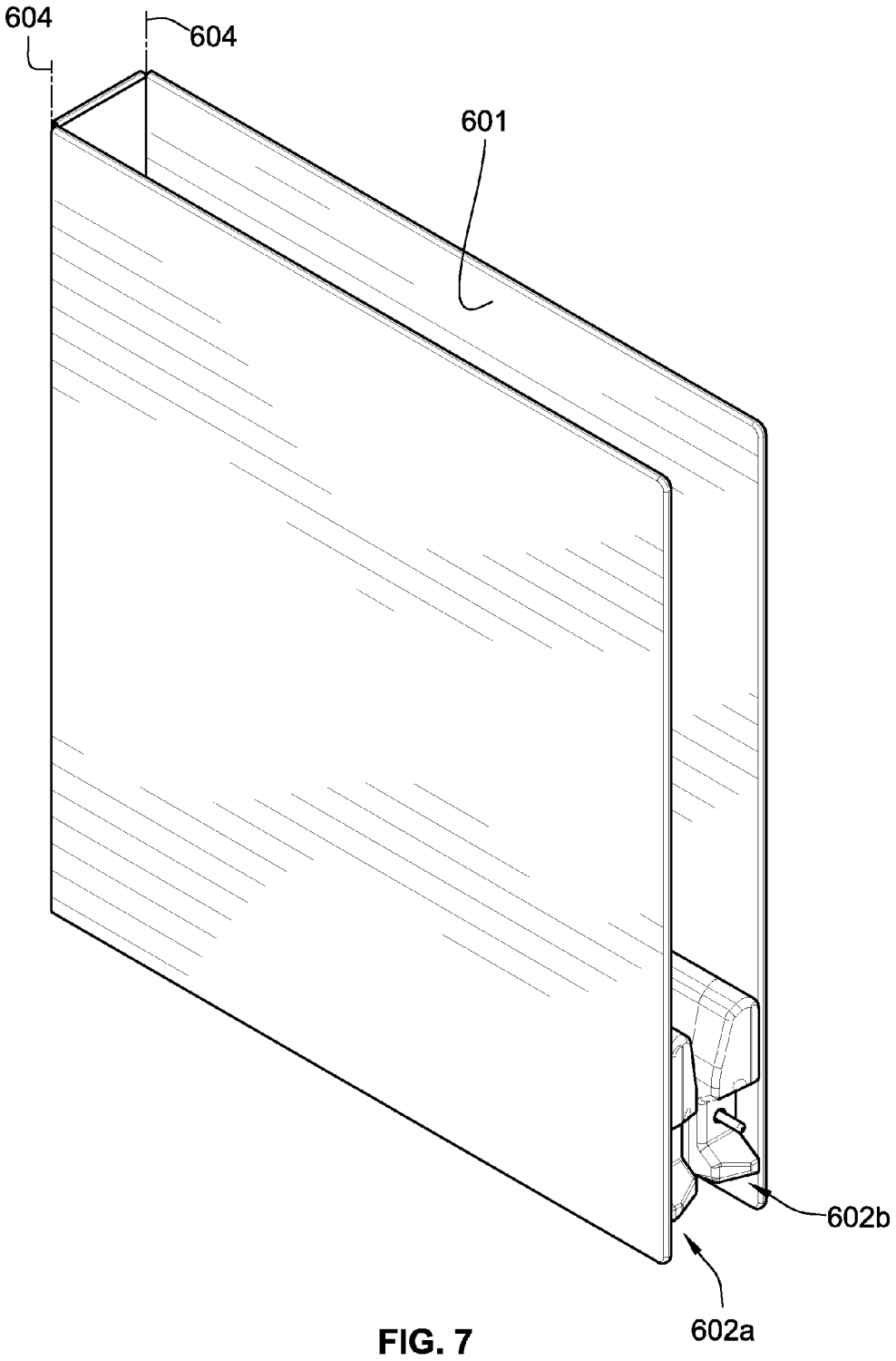
FIG. 7 shows the music portfolio in a folded position.

Furthermore, the portfolio 601 further includes a pair of vertical living hinges 604 that permit the portfolio 601 to be folded generally in half along respective vertical axes for storage and transportation. Referring to FIG. 7, the portfolio 601 is illustrated in a folded position in which (a) the portfolio 601 has been folded along the living hinges 604 and (b) the light bars 602*a*, 602*b* have been folded upwards along the hinges 603.

The light provides complete and substantially uniform illumination of both facing pages of the music score (i.e. the complete planar area to the portfolio) while minimizing any light that washes beyond the music score over the sides and the top of the portfolio.

Figure 8:
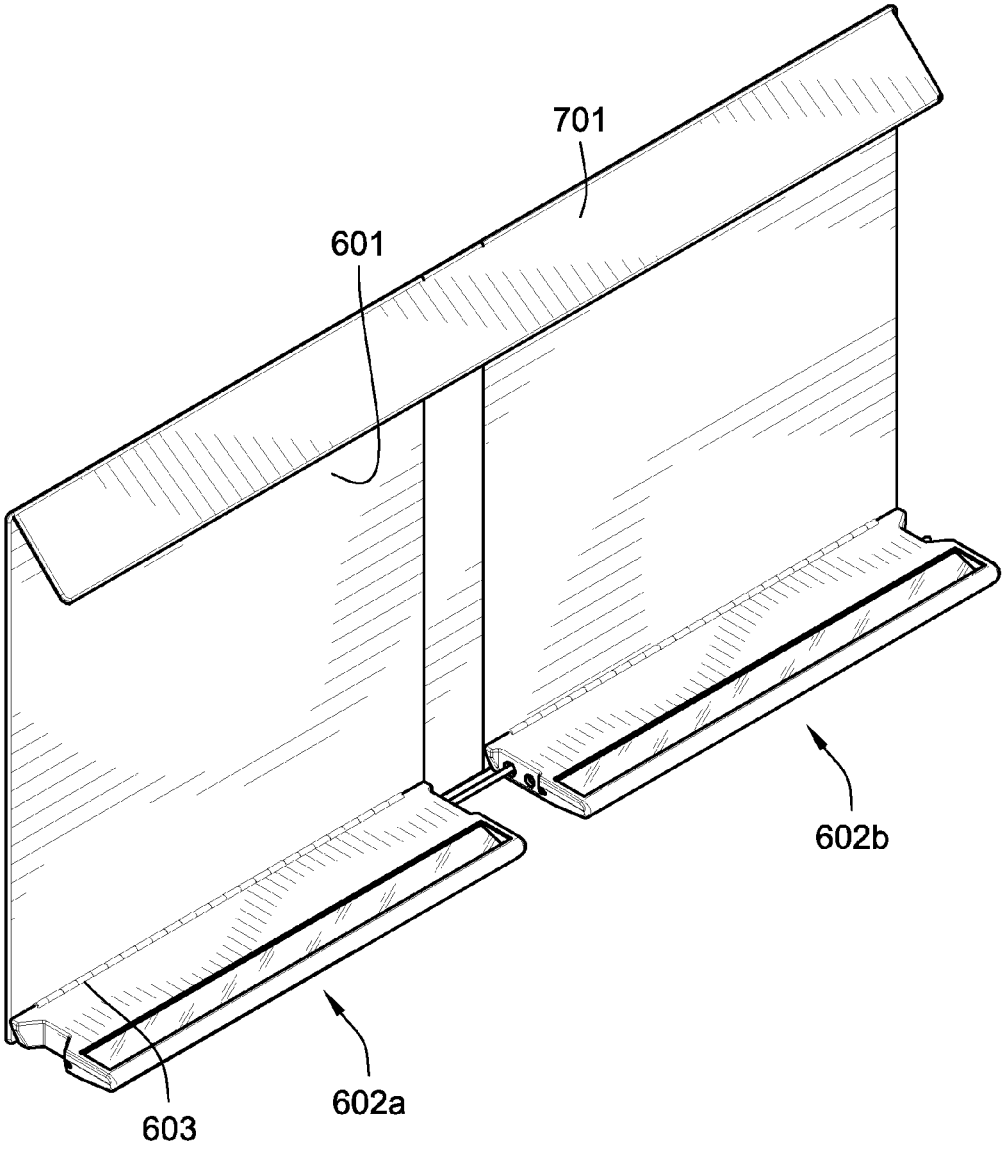
FIG. 8 shows a top reflector option for the music portfolio.

As per FIG. 8, optionally, a flip-up shield 701 (or top reflector) can be added at the top to absorb spillage. This can be useful, for example, if the portfolio 601 supports variable sizes. Optionally, the flip-up shield 701 includes a mirror on an internal, light-receiving surface for improving the performance of the flip-up shield 701

Different configuration of the portfolio 601 can be created by integrating light bars of similar or different dimensions and characteristics can be integrated on each side of the portfolio and/or on the top and/or bottom of the portfolio.

Alternatively the portfolio could comprise three or more planar surfaces, each of which having a light bar at the bottom and/or top.

The characteristics of the light bars are designed to achieve a uniform light across the surface. For example, the side light bars may consist of a lower number of rows of LEDs, where each row consists of a larger number of LEDs.

The light bar can be mounted on a sliding mechanism to allow it to be extended out further (to account for thicker books).

One or more light bars can be integrated into any planar surface that requires lighting. For example, it can be integrated into a picture or artwork frame, either at the bottom, top or sides or any combination thereof.

One or more light bars can be integrated into a book holder to be used as a portable book light.

One or more light bars can be integrated at the base of a tripod or pedestal for presentations or to display menus.

While particular embodiments and applications of the present invention have been illustrated and described, it is to be understood that the invention is not limited to the precise constructions and compositions disclosed herein and that various modifications, changes, and variations may be apparent from the foregoing descriptions without departing from the spirit and scope of the invention as defined in the appended claims.

The invention claimed is:

1. A method of illuminating a surface, said method comprising:

positioning an elongated housing along an edge of said surface to be illuminated, said housing containing at least one row of light emitting diodes (LEDs) mounted within said housing and spaced within said housing to produce light radiating forwardly away from said surface and within said housing, said housing having a wall adjacent to and extending substantially perpendicularly away from said edge and having a transparent portion that is positioned and dimensioned to pass light from the reflecting surfaces substantially only onto the area to be illuminated;

energizing said LEDs to produce light for illuminating said surface; and reflecting said light from said LEDs off a plurality of reflectors located within said housing spaced from said row of LEDs, positioned to intercept light propagating from said LEDs, and oriented to reflect said light beams through said transparent portions of said housing wall and onto said surface, said reflectors being oriented at different angles to direct the reflected light substantially uniformly onto different areas of said surface, said different areas encompassing substantially the entire area of said surface.

2. The method of claim 1, wherein said surface to be illuminated is substantially vertical, said light bar extends along a bottom edge of said surface, and said wall adjacent said surface is a top wall of said housing.

3. The method of claim 1, further comprising pivotably connecting the bottom of said surface to said housing such that said wall of said housing is oriented to support a bottom edge of sheet music resting against said surface, said light from said LEDs illuminating a front surface of said sheet resting against said surface.

4. The method of claim 1, further comprising forming a portfolio for carrying sheet music by connecting the housing and said surface.

5. A light bar for illuminating a substantially vertical surface that is substantially perpendicular to said light bar, said light bar comprising:

an elongated housing extending along an edge of said surface to be illuminated, said housing having a housing wall adjacent to and extending along and extending substantially perpendicularly away from said edge of said surface to be illuminated, said housing wall having a transparent portion;

at least one row of light emitting diodes (LEDs) mounted within said housing and spaced within said housing to produce light radiating forwardly away from said surface and within said housing;

a plurality of reflecting surfaces located within said housing spaced from said row of LEDs, positioned to intercept light radiating forwardly from said LEDs, and oriented to reflect the intercepted light through said transparent portion of said housing wall and onto said surface, said reflecting surfaces being oriented at different angles to reflect light produced by said LEDs substantially uniformly onto different areas of said vertical surface, said different areas encompassing substantially the entire area of said surface; and said transparent portion of said housing wall being positioned and dimensioned to pass light from the reflecting surfaces substantially only onto the area to be illuminated.

6. The light bar of claim 5 in which said surface to be illuminated is substantially vertical, said light bar extends along a bottom edge of said surface, and said wall adjacent said surface is a top wall of said housing.

7. The light bar of claim 5 in which said plurality of reflecting surfaces include a first mirror oriented to illuminate a lower portion of said surface, and a second mirror oriented to illuminate an upper portion of said surface.

8. The light bar of claim 5, further comprising a pivotable connection for connecting to the bottom of said surface such that the wall of said housing is oriented to support bottom edges of sheet music resting against said surface, said light from said LEDs illuminating a front surface of said sheet music resting against said surface.

9. The light bar of claim 5 in which said housing and said surface are adapted to form a portfolio for carrying said sheet music.

* * * * *